US006938665B2

(12) United States Patent
Lewis, Jr. et al.

(10) Patent No.: US 6,938,665 B2
(45) Date of Patent: Sep. 6, 2005

(54) DOOR

(75) Inventors: John W. Lewis, Jr., Goshen, IN (US); W. Michael Jones, Goshen, IN (US)

(73) Assignee: Philips Products, Inc, Elkhart, IN (US)

( * ) Notice: Subject to any disclaimer, the term of this patent is extended or adjusted under 35 U.S.C. 154(b) by 0 days.

(21) Appl. No.: 09/978,409

(22) Filed: Oct. 16, 2001

(65) Prior Publication Data

US 2003/0070768 A1 Apr. 17, 2003

(51) Int. Cl.[7] ..... A47H 3/36

(52) U.S. Cl. ..... 160/96; 49/67; 49/475.1; 16/365; 16/389; 16/392

(58) Field of Search ..... 49/475.1, 68, 61, 49/67; 160/89, 90, 94, 95, 96; 16/392, 388, 365, 389, 273, 334, 330; 296/146.9, 156

(56) References Cited

U.S. PATENT DOCUMENTS

| | | | | | |
|---|---|---|---|---|---|
| 1,635,920 | A | * | 7/1927 | Belvin | 292/300 |
| 2,537,896 | A | * | 1/1951 | Hinton et al. | 292/1 |
| 3,390,419 | A | | 7/1968 | Foltz | |
| 3,599,275 | A | | 8/1971 | Granzow | |
| 3,921,225 | A | * | 11/1975 | Suska | 16/273 |
| 4,094,099 | A | * | 6/1978 | Birch | 49/163 |
| 4,299,058 | A | * | 11/1981 | Spaulding | 49/386 |
| 4,302,907 | A | * | 12/1981 | Canals et al. | 49/65 |
| 4,351,085 | A | | 9/1982 | Suska | |
| 4,389,817 | A | * | 6/1983 | Olberding | 49/163 |
| 4,549,671 | A | | 10/1985 | Fay, III | |
| 4,573,239 | A | | 3/1986 | Valenti et al. | |
| 4,607,457 | A | * | 8/1986 | Shewchuk | 49/400 |
| 4,799,330 | A | * | 1/1989 | Hudson | 49/62 |
| 4,906,033 | A | | 3/1990 | Sargent et al. | |
| 6,079,766 | A | | 6/2000 | Butler et al. | |
| 6,149,222 | A | | 11/2000 | Schambre et al. | |
| 6,196,617 | B1 | | 3/2001 | Beck | |
| 6,247,744 | B1 | | 6/2001 | Townsend et al. | |

* cited by examiner

*Primary Examiner*—Blair M. Johnson
(74) *Attorney, Agent, or Firm*—Calfee, Halter & Griswold LLP

(57) ABSTRACT

A door frame with a substantially continuous sealing surface supports a door with a substantially continuous sealing member mounted thereon. A stepped U-shaped frame member has an opening at one end that is closed with a square-cut member, such as a threshold. The frame, threshold and hinges mounted on the frame provide a substantially continuous sealing surface. The bores of the hinge knuckles may be matched with bushings in the bores, so that the bushings must be properly oriented. The heads of the bushings may have at least two steps or raised contact surfaces and at least two indentations or depressed contact surfaces. When the doors are opened, the steps on their bushings in the pivoting hinge leaves drop into the indentations in the adjacent fixed hinge leaf and hold the door in position.

17 Claims, 7 Drawing Sheets

DOOR

TECHNICAL FIELD

This invention relates to doors. More particularly, it relates to combination doors, for vehicles such as motorized recreational vehicles, utility trailers and the like, that are designed for trouble free and comfortable service, and for economical, efficient and flexible production.

SUMMARY OF THE INVENTIONS

This invention provides a door assembly with a frame assembly having a substantially continuous sealing surface around the entire periphery of the frame assembly. A first door, such as a prime door, has a substantially continuous sealing member mounted thereon. The sealing surface and sealing member provide a substantially continuous seal around the door when it is closed. Preferably, a second substantially continuous seal on a second door, such as a screen door, seals against insects. The weather seal on the prime door and the insect seal on the screen door are mechanically fastened or otherwise attached to the main frame of the door for consistent performance and aesthetics.

In one embodiment, a stepped U-shaped frame member has an opening at one end that is closed with a square-cut member, such as a threshold, leaving gaps at the outer steps of the frame. Plugs fill these gaps, providing a continuous surface without expensive machining of the threshold. The frame and doors shown herein have curved upper corners, but it should be understood that the term "U-shaped" includes other shapes with three closed sides and one open side, such as a rectangular door frame with a straight top and sides.

Continuous sealing surfaces may be formed with interfitting frames and hinges. The preferred frame has a rib with an outwardly facing surface that forms much of the sealing surface. The rib is notched to accept the fixed hinge leaf of a hinge assembly. The fixed hinge leaf is stepped to fit into a notch in the frame rib, and to provide a surface that is substantially coplanar with the outwardly facing surface of the rib. In turn, the fixed hinge leaf is notched to accept at least one pivoting hinge leaf, which is also stepped to provide a surface that is coplanar with the above-identified surfaces of the fixed hinge leaf and the frame rib. The end result is a substantially coplanar, outwardly facing sealing surface that extends through the hinge area, eliminating the need for multiple, specially constructed seal parts, which improves seal integrity.

Inter-fitting frames and hinge parts can also simplify manufacture, strengthen the completed assembly and help meet Federal motor vehicle safety standards, such as Federal Standard FMVSS 206. For example, the main frame assembly for a door may have a groove with an undercut or dovetail surface, and parts of a hinge assembly attached to this frame may have a rib with an outwardly sloping surface that complements and interlocks with the dovetail groove in the frame. Another interlocking system has a component, such as a door surround, with kerfs to support a sealing member and notches for other components, such as hinge leafs, which also have kerfs for the sealing member. The surround has a rib that fits into a grove on the hinge leaf, which ensures precise alignment of the kerfs, facilitates installation of the sealing member and increases structural integrity.

The preferred door assembly has at least one hinge assembly with a mounting plate having an upper fixed knuckle, a lower fixed knuckle and, optionally, one or more intermediate fixed knuckles. Stepped bushings, with bodies that complement the bores of the knuckles, and larger heads that ride on the rims of the knuckles, are inserted into the top end of the fixed hinge bushings, and into the bottom end of the knuckle or knuckles of one or more pivoting hinge leafs that fit between and are coaxial with the fixed hinge knuckles. As a result, the bushings in the pivoting leafs, which support the door or doors, bear on bushings in fixed knuckles. The hinge pin extends through these bushings and, optionally, through cylindrical plugs that limit the required length of the bushings and ease molding requirements. The moveable hinge leaf can pivot with respect to the fixed hinge leaf without metal-to-metal contact between the knuckles, and between the pin and the knuckles. Metal-to-metal wear is eliminated, which also reduces attendant discoloration.

The bores and bushings are preferably designed, e.g. with matching grooves and ribs, so that the bushings must be properly oriented to fit into the bores. In one embodiment, the heads of the bushings have at least two steps or raised contact surfaces and at least two indentations or depressed contact surfaces. When the doors are opened, the steps on their bushings in the pivoting hinge leaves drop into the indentations in the adjacent fixed hinge leaf and hold the door in position.

Other features and advantages of this invention will be apparent from the following detailed description.

DRAWINGS

Figure 5:
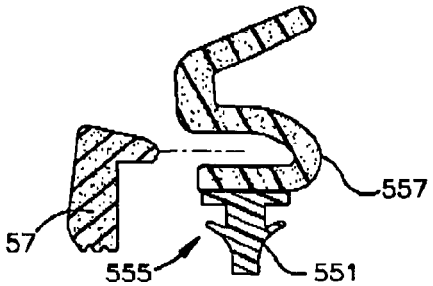

FIG. 5 provides detail views of the weather seal and an optional noise reduction seal.

Figure 6:
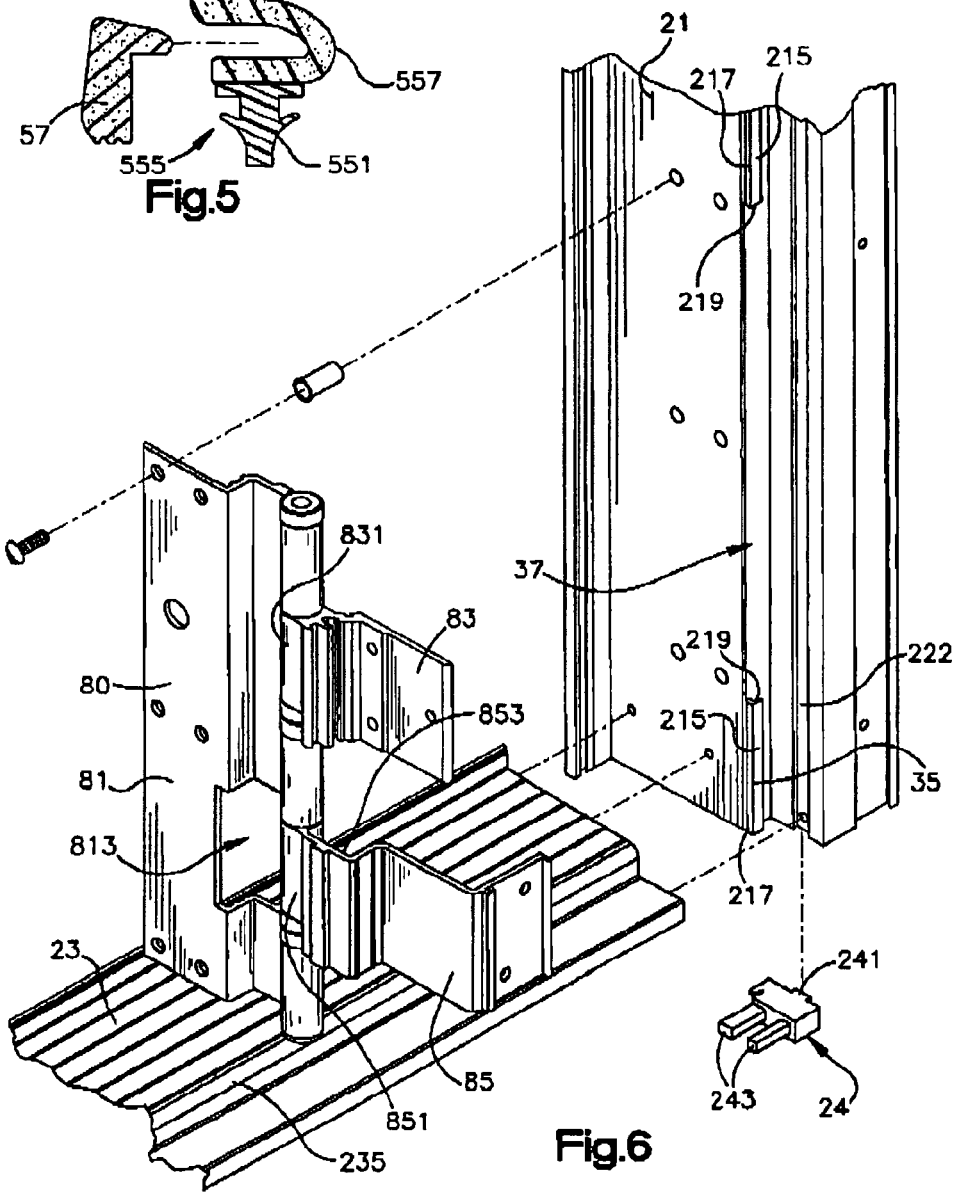

FIG. 6 is a fragmentary, exploded, isometric view of the main door frame member, threshold and hinge assembly for the door illustrated in the previous figures.

Figure 7:
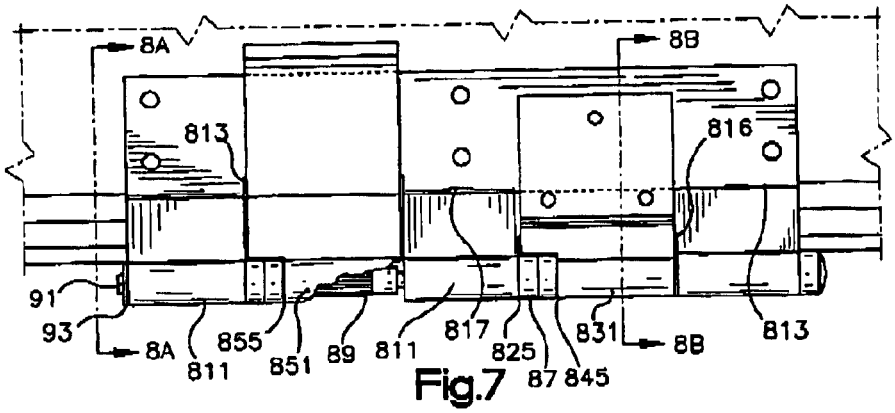

FIG. 7 is a side elevation view of a hinge assembly with fragments of the main frame assembly on which it is mounted.

Figure 8A:
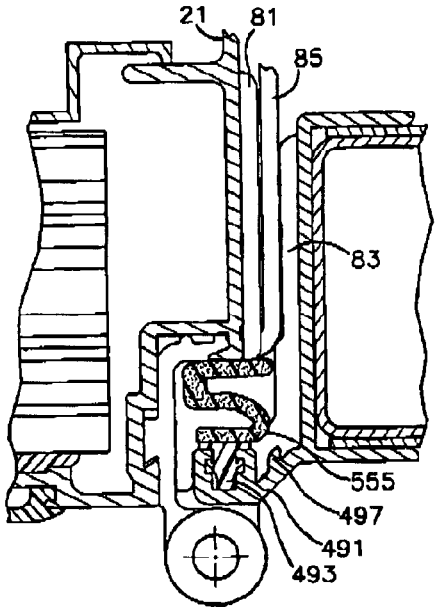
Figure 8B:
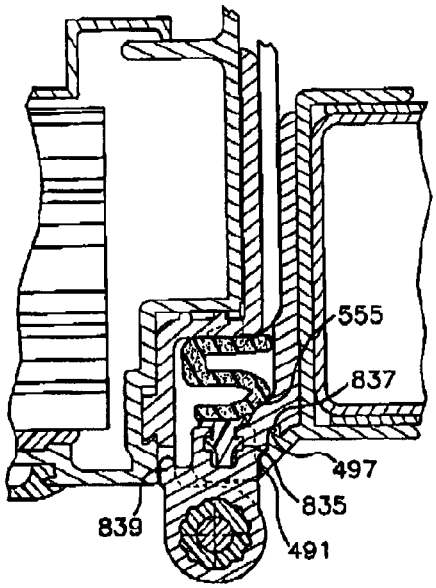

FIGS. 8A and 8B are expanded, fragmentary cross sectional views along lines A—A and B—B respectively in FIG. 7.

Figure 9A:
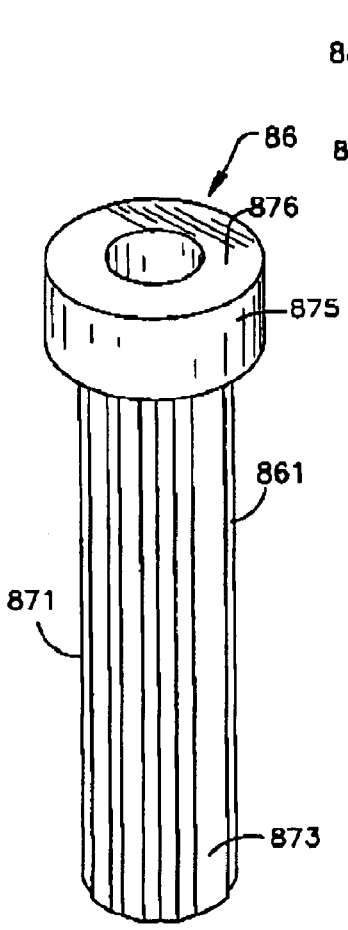
Figure 9B:
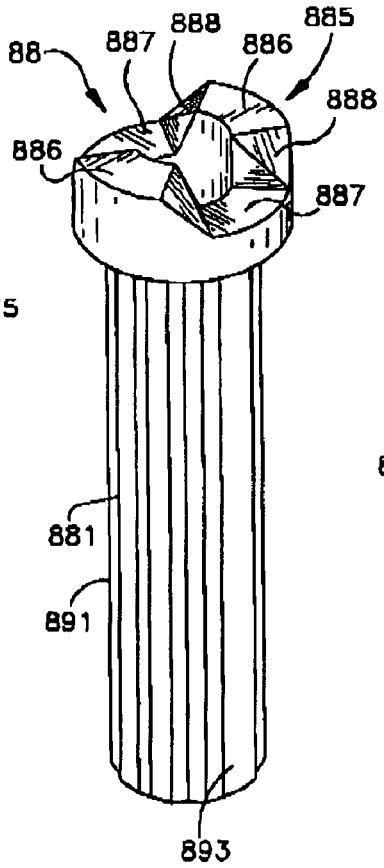
Figure 9C:
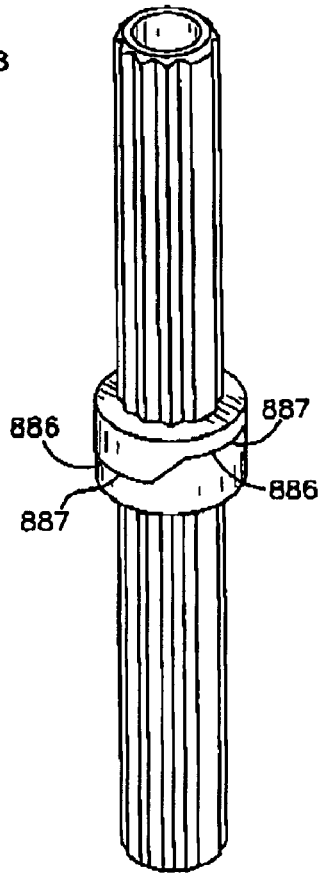

FIGS. 9A, 9B and 9C are isometric views of two bushings that may be used in hinges for doors embodying this invention.

Figure 10:
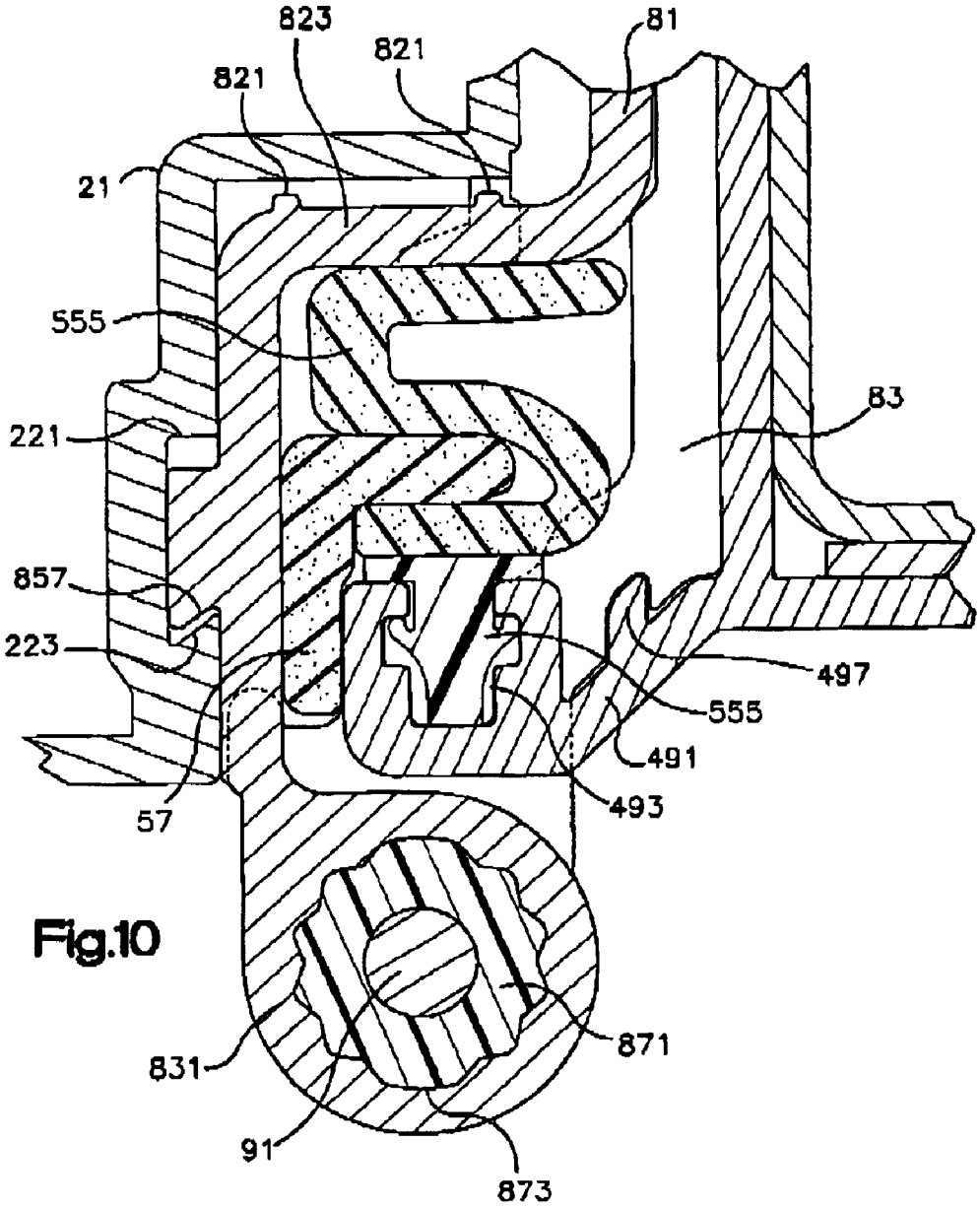

FIG. 10 is a further enlarged, fragmentary crosssectional through the screen hinge leaf, fixed hinge leaf and main frame member of the assembly shown in the forgoing figures.

DETAILED DESCRIPTION

Figure 1:
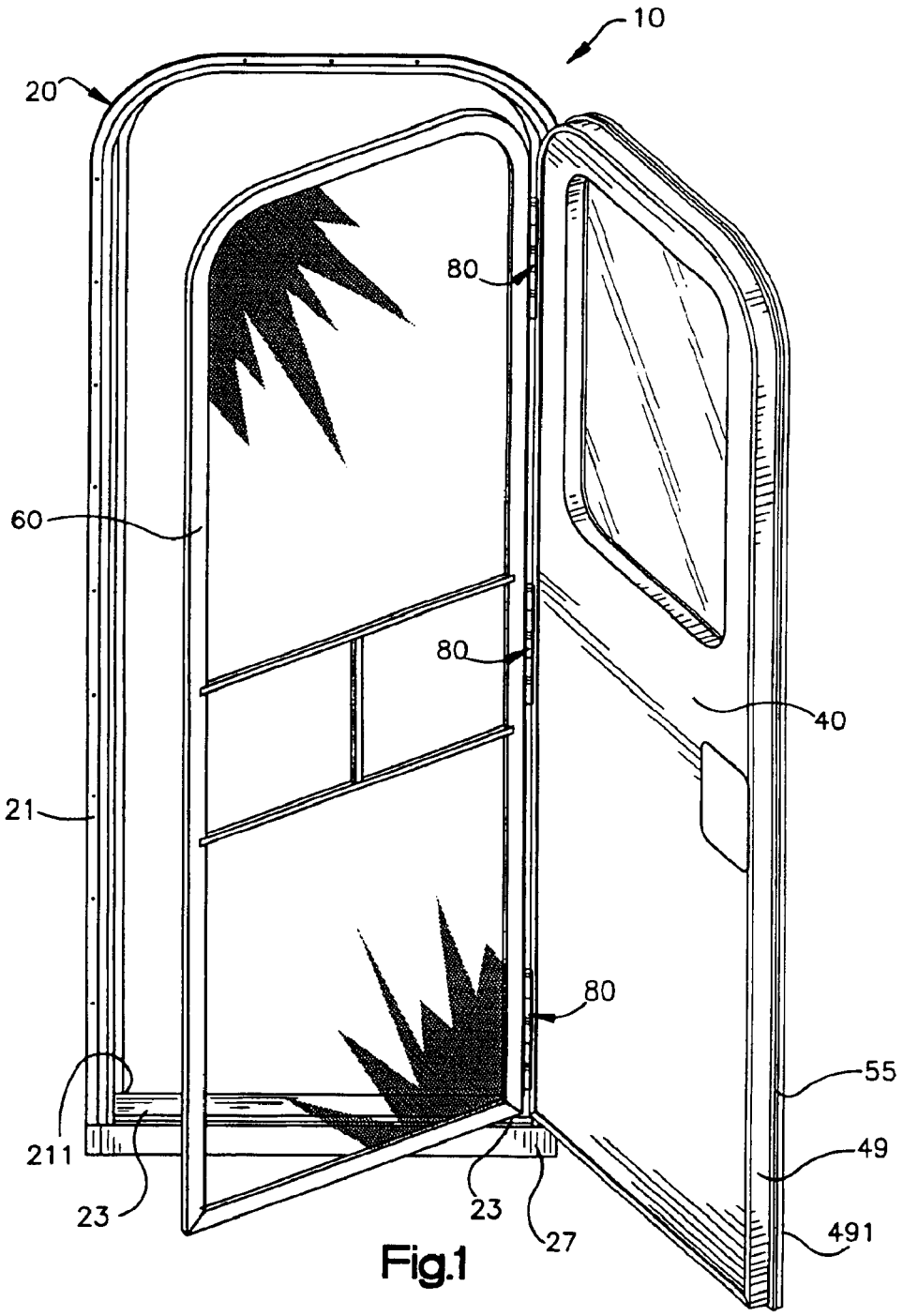
FIG. 1 is an isometric view of a door assembly embodying this invention.
Figure 2:
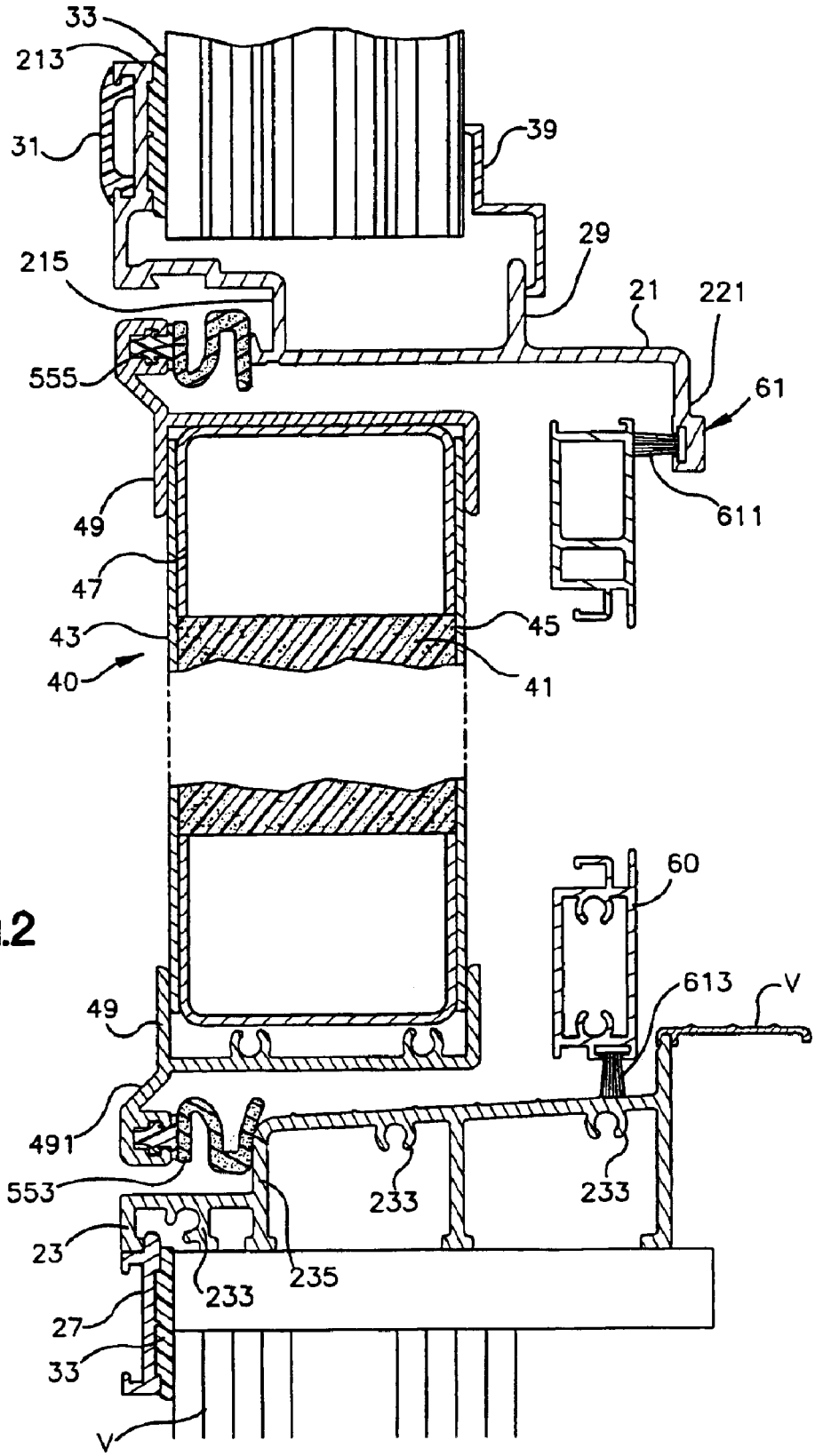
FIG. 2 is a vertical cross section through the prime door shown in FIG. 1.
Figure 3:
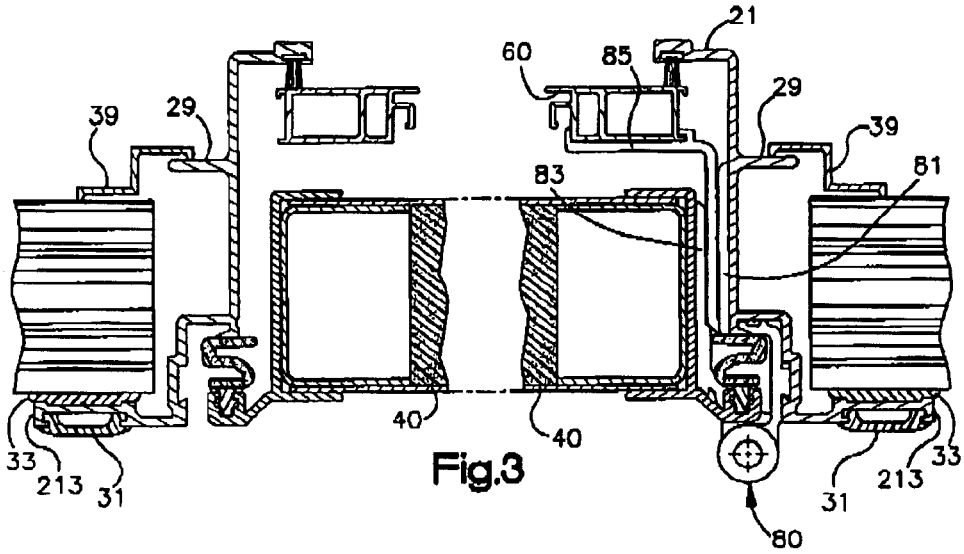
FIG. 3 is a horizontal cross section through the same prime door.

The door assembly illustrated in FIG. 1, generally referred to as 10, includes: a frame assembly 20, a prime door 40, and a screen door 60. Frame assembly 20 has a U-shaped main frame member 21 with an open lower end 211, which is closed by an extruded aluminum threshold 23, attached to the main frame member by screws (not shown) that extend through the frame member into semicircular screw bosses 233 shown in FIG. 2. Threshold 23 rests on the body of the vehicle V in which the door assembly is installed. As shown in FIGS. 2 and 3, the main frame member is fastened to the vehicle by screws (not shown) extending through a mounting flange 213 and a layer of butyl tape 33, which seals any gaps between the main frame member and the side of the vehicle. A screw cover 31, which snaps into mounting flange 213, covers these screws. A laterally extending flange 29 on the main frame, and a trim ring 39, attached to the inner wall of the vehicle, close any gaps between the inside wall and the frame. A sill filler strip 27, attached to the vehicle by screws (not shown) extending through the filler strip and through a layer of butyl tape 33, closes any gap between the lower edge of the threshold and the vehicle.

Figure 4:
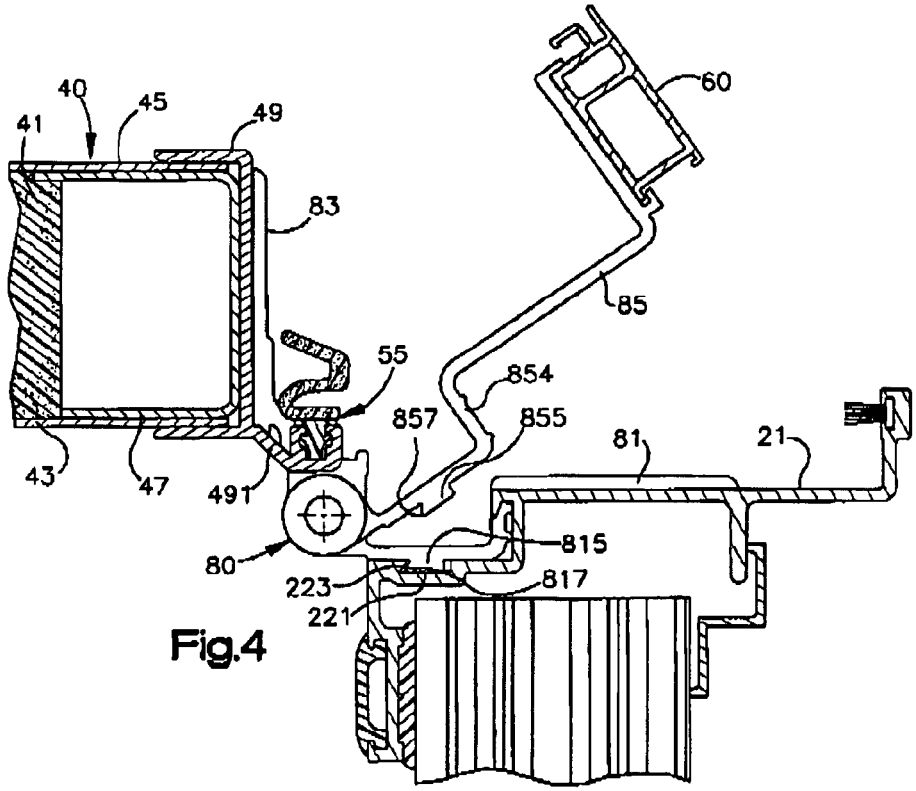
FIG. 4 is an enlarged fragmentary cross section of the door in FIG. 3, with the mainframe and screen door leaf pivoted 90° and 45° respectively for ease of understanding.

The doors are attached to the frame by three hinge assemblies 80, shown in FIGS. 3, 4, and 6–10. Each hinge assembly consists of a fixed leaf 81 bolted to the main frame 21, a prime leaf 83 which supports the prime door 40, a screen leaf 85 which supports the screen door 60, and associated hardware described below. FIG. 3 provides a horizontal cross-sectional view of a hinge, with the doors in the closed position. The enlarged fragmentary cross-sectional view in FIG. 4 shows the frame 21 and screen door 60 rotated clockwise 90° and 45°, respectively, for ease of understanding.

The prime door 40 has a core 41 of an expanded material such as polystyrene, a smooth skin 43 of a material such as fiberglass or aluminum on the outside of the core, and a similar smooth skin 45 on the inside of the core. A generally U-shaped steel stile 47 protects the edges of the foam core, and provides substantial strength and rigidity. The inner and outer skins 43, 45, are laminated to the core 41 and to the stile 47. As also shown in FIGS. 2–4, an extruded aluminum door surround 49 encloses and reinforces the outer and inner door skins 43, 45 and the stile 47. Surround 49 has a seal flange 491 which, in connection with hinge assemblies 80, supports a substantially continuous weather seal assembly 55, as explained below. An unbroken U shaped weather seal member 555, mounted in cruciform-shaped kerfs 493 in the door surround seal flange 491, and in kerfs 835 in the prime hinge leafs 83, as shown in FIGS. 8A, 8B and 10, provides an unbroken U-shaped weather seal around the sides and top of the prime door 40. Weather seal member 555, in conjunction with a lower seal member 553 mounted in the door surround seal flange 491 at the bottom of the prime door, forms a substantially continuous unbroken weather seal 55 around the prime door.

The kerf 835 in the prim hinge leaf 83 supports weather seal member 555, as shown in FIGS. 7 and 8B, across the notch 816 (in the fixed hinge leaf 81) or the prime hinge leaf. The kerf 493 in surround seal flange 491 supports the weather seal 555 around the rest of the main frame, as shown in FIGS. 8A and 10, and supports the weather seal assembly 553 across the bottom of the door. Kerfs 493 and 835 are aligned. Thus, they provide continuous support for the unbroken weather member 555, and eliminate any requirement for short seal pieces in the hinge area.

As shown in FIG. 5, weather seal members 555 and 553 have two parts: a relatively rigid spine 551 which is inserted into kerfs 493 and 835, and a more flexible serpentine member 557. The spine is preferably made of a relatively rigid material such as polypropylene, and the serpentine member is preferably made of a more flexible material such as SANTOPRENE® Shore 65A Flexible, which are made by Monsanto. These materials can be co-extruded to make a single integrated strip.

A noise reduction seal 57 may optionally be used with weather seal member 555. As shown in FIG. 5 and 10, noise reduction seal 57 is L-shaped. The shorter leg fits into the outer curve of the seal member 555. Adhesive secures the other leg to the outside of the door surround seal flange 491. When used, the noise reduction seal preferably extends from the threshold to the top of the straight portion of the hinge side of the prime door. The noise reduction seal may be an extruded foam.

When the prime door is closed, weather seal 55 presses against a substantially continuous and coplanar sealing surface formed by main frame member 21, threshold 23, and the hinge assemblies 80. As best seen in FIGS. 6 and 10, the main frame member 21 has an outwardly extending rib 35 with an outwardly facing surface 215 which is one of the main parts of this continuous sealing surface. The threshold 23 has a similar outwardly facing surface 235. As may be seen in FIG. 2, surfaces 215 and 235 are substantially coplanar, and are substantially parallel to the outer and inner skins 43, 45 of the door when the door is closed.

As also best seen in FIG. 6, the rib 35 on the main fame has notches 37 for the hinge assemblies 80. Similarly, the fixed leaf 81 of each hinge assembly has notches 813 for the screen door leaf. The outwardly facing, unnotched sections 215 of the main same seal rib 217, the outwardly facing, unnotched sections of the fixed hinge leaves and the outwardly facing sections 853 in the screen hinge leaves 85 are substantially coplanar and provide a continuous outwardly facing sealing surface across the hinges. Thus, an unbroken seal can be provided across the hinges with a single unbroken weather sealing member 555, which contributes significantly to performance, dependability and manufacturing economy.

Referring to FIGS. 6 and 10, there are two small ribs 821 on the back side of the rearwardly extending or laterally facing step 823 in the fixed hinge leaf 81. They minimize the risk that flash or scrap from the cutting of the notches 813 in the fixed hinge leaf will keep the hinge assemblies from being positioned properly in the main frame notches 219.

The main frame member, hinge assemblies and prime door are also designed for ease of assembly and structural integrity. As best seen in FIG. 4, the main frame assembly has a groove 221 20 with an inwardly sloping or dove-tailed side 223. The fixed hinge leaf and screen hinge leaf have ribs (815 and 855 respectively) with complimentary front edges 817, 857 that fit into and interlock with the sloping side 223 of groove 221. This facilitates alignment of the hinge assembly during assembly, and provides additional strength.

In addition to providing a continuous mount for weather seal member 555, as described above, prime hinge leaf 83 and door surround 49 contribute to ease of assembly, structural integrity, and effective sealing. As may be seen in FIGS. 8A and 8B, a rib on the door surround seal flange 491 extends into a mating groove 837 on the prime hinge leaf 83. This ensures perfect alignment of the kerf 493 in the surround and the kerf 835 in the prime hinge leaf, and also contributes to structural rigidity. The prime hinge leaf also has a rib 839, on the opposite side of the leaf from groove 837. As seen in FIG. 10, this closes the gap created by the notch 815 for the prime hinge knuckle 831 when the prime door is closed.

The weather seal provided by seal assembly 55 is supplemented by a screen door seal assembly 61, shown in FIG. 2, consisting of a U-shaped strip 611 of pile, preferably polypropylene, mounted in a screen door seal flange 221 at the inner end of mainframe member, and a similar strip 613, mounted in the bottom of the screen door.

As best seen in FIG. 6, the filler plug 24 has a rib 241 which fits into the groove 222 in the main frame member, and 2 prongs 243 which are inserted into spaces in the outer (and lowest) section of threshold 23.

As best seen in FIG. 7, the fixed hinge leaf has three knuckles 811 for a hinge pin 91. These knuckles are separated by two notches: a smaller notch 814 for the prime hinge leaf 83 and a larger notch 815 for the screen hinge leaf 85. The prime hinge leaf and screen hinge leaf have similar knuckles (831 and 851 respectively), partially cut away to accommodate acetal plastic hinge bushings 87, which are inserted into the top of the bores 825 in the fixed hinge leaf knuckles 811 and the bottom of the bores 845, 856 in the prime hinge leaf knuckle 831 and screen hinge leaf bushing 851. Hinge pin 91 extends through the bushings, through plugs 89 in each knuckle, one of which is illustrated in the cut-away portion of the screen leaf bushing in FIG. 7, and through a washer 93 beneath the lowest fixed hinged bushing. The lower end 91 of the hinge pin is swedged to provide a secure assembly. With the positive location afforded by the notches in the weather seal rib 217, the hinge assemblies lend themselves to removal of an entire door and/or replacement of an individual hinge, if damaged through negligence.

The bushings in hinge knuckles 811, 831 and 851 may be designed to hold one or both doors in a certain open position. FIGS. 9A and 9B illustrate two types of bushings 86, 88. The bodies 861, 881 of both bushings, i.e. the smaller parts of the bushings that are inserted into the bores in the hinge knuckle, have a number of relatively narrow, "V" shaped ribs 871, 891 designed to fit into complimentary V shaped grooves in the bores of the hinge knuckles 811, 831 and 851, best seen in FIG. 10, and one or more wider ribs designed to fit into wider grooves 823 in the bores of the knuckles. As best seen in FIG. 10, the illustrated bores and bushings have two wider grooves or ribs, on opposite sides of the bore or bushing. Thus, the illustrated bushings can be inserted into the illustrated bushings in two positions, 180° apart.

Bushing 86 has a head 875 with a flat contact surface 876 that does not influence the position of either door, but indexing bushing 88 is designed to hold either door in place when it is opened 90°. The head 885 of the indexing bushing 88 has two steps 886 on opposite sides of head 875, and two indentation is 887 separating the steps. Inclined surfaces 888 connect the steps and indentations. Each of the steps and indentations surfaces spans an arc of approximately 30°

With these indexing bushings, the steps 886 of the bushings in the prime hinge knuckle 831 and the screen hinge knuckle 851 rest on the steps 886 of bushings in fixed hinge knuckles 811 when the doors are closed. However, when a door is opened 90°, the steps of the bushings in the pivoting leaves will rest in the indentations of bushings in fixed hinge knuckles 811, and the door will remain in this position until it is closed, manually, or opened further. The doors described above are considerably thicker than conventional doors. This provides extra stiffness and allows the doors to be manufactured as a flat assembly, unlike conventional doors that bowed to provide compression against seals to provide additional compression against seals and reduce door vibration and "flutter" in motion. The ability of the doors to seal as a flat rather than a concave assembly reduces closing force and adds to the perceived quality of the door during operation. As those skilled in the art will recognize, the structures described above, shown in the accompanying drawings and defined by the following claims offer substantial advantages over door assemblies previously available for recreational vehicles, including a substantially continuous sealing surface around the entire periphery of the main door frame, which in turn makes it feasible to use a substantially continuous weather seal around substantially the entire periphery of the door, including the area where the hinges are mounted. The substantially continuous sealing surface is formed, in part, with an interfitting frame and hinges. The hinges are also mechanically locked into the frame, which increases structural integrity and eases assembly. Knuckles of the pivoting leaves of the hinges are spaced from the fixed leaf knuckles by bushings, and further separated from the hinge pin by plugs. The bushings and plugs eliminate metal-to metal wear. The bushings may also serve as indexing function, holding the doors in position when open.

Of course, those skilled in the art will readily appreciate that many modifications may be made in the structure disclosed above. The foregoing description is merely illustrative, and is not meant to limit the scope of this invention, which is defined by the following claims.

We claim:

1. A door assembly comprising:

a frame assembly designed and adapted to define a substantially unbroken sealing surface around substantially the entire periphery of said frame assembly said frame assembly having notches; and a first door having a substantially continuous sealing member mounted on said first door;

said sealing member being designed and adapted to engage said sealing surface and thereby provide a substantially continuous seal around said door when said door is closed;

further comprising a second door and a plurality of hinge assemblies supporting said second door, said hinge assemblies comprising hinge leafs designed and adapted to pivot into said notches as when said second door is pivoted into a closed position, whereby a section of said hinge assembly and a section of said notched surface are substantially coplanar and define a portion of said substantially unbroken sealing surface.

2. A door assembly comprising:

a frame assembly designed and adapted to define a substantially unbroken sealing surface around substantially the entire periphery of said frame assembly; and a first door having a substantially continuous sealing member mounted on said first door;

said sealing member being designed and adapted to engage said sealing surface and thereby provide a substantially continuous seal around said door when said door is closed;

wherein said frame assembly has one or more frame notches, further comprising:

a second door and a plurality of hinge assemblies supporting said first door and said second door, said hinge assemblies comprising:

a stepped fixed hinge leaf, designed and adapted to be mounted in said frame notch and having an outwardly facing edge with one or more hinge leaf notches;

a first hinge leaf designed and adapted to support said first door; and a stepped, second hinge leaf designed and adapted to support said second door and to pivot into said hinge leaf notch when said second door is pivoted into a closed position, whereby sections of said second hinge leaf, said fixed hinge leaf and said frame are substantially coplanar and define a portion of said substantially continuous sealing surface.

3. A door assembly according to claim 2 herein said door assembly comprises a prime door and a screen door and said second hinge assembly supports said screen door.

4. A door frame assembly comprising:

a stepped, U-shaped frame member having:

a first, laterally facing section designed and adapted to be mounted to a structure;

a second, outwardly facing section designed and adapted to define a sealing surface;

a third, exterior terminating section; and a stepped, square cut threshold having:

a outwardly facing section that is substantially coplanar with said outwardly facing section of said frame member; and an outer section that extends outward from said outwardly facing section and has an end that is square cut with and substantially coplanar with an end of said exterior terminating section, whereby there is a space between the end of said outer section of the threshold and the third exterior terminating section of said U-shaped frame member; and a plug attached to at least one of said threshold and said frame member, and closing said space.

5. A door according to claim 4 wherein said plug comprises nylon.

6. A door assembly having at least one hinge assembly mounted on a door frame, said hinge assembly comprising:

a mounting plate having an upper fixed knuckle and a lower fixed knuckle, each of said knuckles having bores with a common axis;

stepped bushings with first sections mounted in said bores and second sections that are larger than said bores, said bushings being inserted into said bores so that the larger section of one bushing is above the upper knuckle and the larger section of another bushing is above the lower knuckle;

a hinge leaf having a leaf knuckle that is positioned between and has a bore that is substantially coaxial with the bores of said upper fixed knuckle and said lower fixed knuckle;

a stepped leaf bushing having a first section mounted in said leaf bore and a second section that is larger than said leaf bore, said leaf bushing being inserted into said leaf bore so that said second section of said leaf bushing is below said leaf knuckle and is supported by the bushing mounted in the lower knuckle; and a metallic pin extending through said bushings, whereby said hinge leaf can pivot with respect to said mounting plate with minimal metal-to metal wear between said knuckles, and between said pin and said knuckles;

said bores comprising narrower orienting grooves and at least one wider orienting groove with a bottom that is wider than a bottom of said narrower orienting groove; and the bodies of said bushings comprising narrower orienting ribs designed to fit into said narrower orienting grooves, and at least one wider orienting rib designed to fit into said wider orienting groove.

7. A door assembly according to claim 6 wherein said bores have at least two of said wider orienting grooves and the bodies of said bushings have at least two of said wider orienting ribs.

8. A door assembly according to claim 6 wherein said heads of said bushings comprise contact surface on the opposite side of the heads from the bodies of the bushings, and said contact surfaces comprise at least two raised contact surfaces, at least two depressed contact surfaces, each of said depressed contact surfaces being between two of said steps, with inclined surfaces between said steps and said valleys.

9. A door assembly according to claim 8 wherein said steps are substantially flat and coplanar, and said valleys are substantially flat, coplanar and parallel to said steps.

10. A door assembly to claim 9 wherein said inclined surfaces have a substantially constant slope.

11. A door assembly according to claim 6 further comprising at least one annular plug inserted into the opposite end of one of said bores from the larger end of the bushing inserted into said bore.

12. A door assembly according claim 11 wherein said annular plugs are inserted into the opposite ends of all of bores in the hinge knuckles of said assembly from, and said metallic pin extends through all of said plugs and bushings.

13. A door assembly according to claim 6 wherein said bushings comprise acetal plastic.

14. A door assembly comprising:

a door with a door groove designed and adapted to support a weather seal;

a hinge leaf having a leaf groove designed and adapted to support a weather seal, said leaf groove being aligned with the door groove; and a weather seal extending through the door groove and the leaf groove;

wherein said door comprises an edge member having an arm extending therefrom and said door groove comprises a slot with a cruciform cross-section in said arm; and said leaf groove comprises a cruciform slot.

15. A door assembly according to claim 14 wherein said weatherseal comprises a cruciform section designed and adapted to be mounted in said grooves, and a serpentine section extending from said cruciform section.

16. A door assembly according to claim 15 wherein said cruciform section of said weather seal comprises polypropylene and said serpentine section comprises a thermoplastic elastomer, and said polypropylene and said thermoplastic elastomer are co-extruded to form said weather seal.

17. A door assembly according to claim 15 further comprising a noise reduction seal said noise reduction seal being attached to said first door and having a section that extends into said serpentine section of said weatherseal.

* * * * *